US009649001B2

(12) United States Patent
Lee et al.

(10) Patent No.: US 9,649,001 B2
(45) Date of Patent: May 16, 2017

(54) VACUUM CLEANER

(71) Applicant: SAMSUNG ELECTRONICS CO., LTD., Suwon (KR)

(72) Inventors: Han Saem Lee, Seongnam (KR); See Hyun Kim, Suwon (KR); Hyeon Cheol Kim, Seoul (KR); Hyun Ju Lee, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 547 days.

(21) Appl. No.: 14/192,240

(22) Filed: Feb. 27, 2014

(65) Prior Publication Data

US 2014/0338148 A1 Nov. 20, 2014

(30) Foreign Application Priority Data

May 20, 2013 (KR) ..... 10-2013-0056258

(51) Int. Cl.
*A47L 9/06* (2006.01)
*A47L 9/24* (2006.01)
(Continued)

(52) U.S. Cl.
CPC ..... *A47L 9/248* (2013.01); *A47L 7/0014* (2013.01); *A47L 9/02* (2013.01); *A47L 9/0653* (2013.01); *A47L 9/0673* (2013.01); *A47L 9/327* (2013.01)

(58) Field of Classification Search
CPC ..... A47L 9/248; A47L 9/0227; A47L 9/06; A47L 9/0633; A47L 9/0653; A47L 9/0673
See application file for complete search history.

(56) References Cited

U.S. PATENT DOCUMENTS 7,260,869 B2 * 8/2007 Kim ..... A47L 9/0027 15/393
2004/0045127 A1 * 3/2004 Albert ..... A47L 9/06 15/415.1

(Continued)

FOREIGN PATENT DOCUMENTS

DE 202009001354 5/2009
EP 1512361 3/2005

(Continued)

OTHER PUBLICATIONS

Extended European Search Report, dated May 12, 2014, in corresponding European Application No. 14157025.9 (6 pp.).

(Continued)

*Primary Examiner* — Laura C Guidotti
(74) *Attorney, Agent, or Firm* — Staas & Halsey LLP

(57) ABSTRACT

Disclosed herein is a vacuum cleaner including a main body generating suction force, a suction head contacting a surface to be cleaned and sucking air and dust from the surface, a handle pipe for user operation, a flexible hose connecting the handle pipe and the main body, and an extension pipe connecting the suction head and the handle pipe. The handle pipe includes a handle pipe body communicating the extension pipe and the flexible hose with each other, and a sub-accessory assembly combined integrally with the handle pipe body so as to suck air and dust from the surface as a substitute for the suction head. In the vacuum cleaner, sub-accessories may be easily replaced, a separate space for storage of the sub-accessories is not required, and there is no danger of loss of the sub-accessories.

18 Claims, 5 Drawing Sheets

(51) Int. Cl.

| | |
|---|---|
| ***A47L 9/32*** | (2006.01) |
| ***A47L 7/00*** | (2006.01) |
| ***A47L 9/02*** | (2006.01) |

(56) References Cited

U.S. PATENT DOCUMENTS

| | | | | |
|---|---|---|---|---|
| 2005/0050673 | A1* | 3/2005 | Kim | A47L 9/0009 15/323 |
| 2011/0047747 | A1* | 3/2011 | Van Herpen | A47L 9/0027 15/410 |

FOREIGN PATENT DOCUMENTS

| | | |
|---|---|---|
| GB | 2477302 | 8/2011 |
| JP | 2000070187 | 3/2000 |
| KR | 10-2003-0008266 | 1/2003 |

OTHER PUBLICATIONS

European Decision on Grant dated Sep. 19, 2016 in corresponding European Patent Application No. 14 157 025.9.

* cited by examiner

VACUUM CLEANER

CROSS-REFERENCE TO RELATED APPLICATION

This application claims the benefit of Korean Patent Application No. 10-2013-0056258, filed on May 20, 2013 in the Korean Intellectual Property Office, the disclosure of which is incorporated herein by reference.

BACKGROUND

1. Field

Embodiments of the present invention relate to a vacuum cleaner having a handle pipe with which sub-accessories are combined integrally so as to be movable.

2. Description of the Related Art

In general, a vacuum cleaner is an electric home appliance which includes a main body generating suction force, a suction head contacting a surface to be cleaned and sucking air and dust from the surface, a handle pipe for user operation, an extension pipe connecting the suction head and the handle pipe, and a flexible hose connecting the handle pipe and the main body, and performs cleaning.

Such a vacuum cleaner may further include various sub-accessories which may perform cleaning as a substitute for the suction head according to kinds and states of the surface to be cleaned.

The sub-accessories may include a crevice tool formed in a flat type to clean a narrow gap and a dusting tool provided with a brush to clean a window frame or a corner.

Such sub-accessories may be provided separately from the handle pipe so that one of the sub-accessories may be mounted on the handle pipe after the extension pipe has been separated from the handle pipe. Therefore, replacement of the sub-accessories may be troublesome and there may be a danger of loss of the sub-accessories which are separately stored.

SUMMARY

Therefore, it is an aspect of the present invention to provide a vacuum cleaner in which sub-accessories are provided integrally with a handle pipe so as to increase convenience in storage and use of the sub-accessories.

Additional aspects of the invention will be set forth in part in the description which follows and, in part, will be obvious from the description, or may be learned by practice of the invention.

In accordance with one aspect of the present invention, a vacuum cleaner includes a main body generating suction force, a suction head contacting a surface to be cleaned and sucking air and dust from the surface, a handle pipe for user operation, a flexible hose connecting the handle pipe and the main body, and an extension pipe connecting the suction head and the handle pipe, wherein the handle pipe includes a handle pipe body communicating the extension pipe and the flexible hose with each other and a sub-accessory assembly combined integrally with the handle pipe body so as to suck air and dust from the surface as a substitute for the suction head.

The sub-accessory assembly may include a dusting tool provided with a brush and a crevice tool to clean a gap.

The sub-accessory assembly may further include a slide member combined with the handle pipe body so as to be slidable, the dusting tool and the crevice tool being combined with the slide member.

The dusting tool may be combined with the slide member so as to be slidable.

The crevice tool may be combined with the slide member so as to be rotatable.

The slide member may be provided to surround the outer circumferential surface of the handle pipe body.

The handle pipe body may include guide grooves formed on the outer circumferential surface thereof to guide movement of the slide member, and the slide member may include guide protrusions formed on the inner circumferential surface thereof to move along the guide grooves.

The slide member may include a guide hole formed on the outer circumferential surface to guide movement of the dusting tool, and the dusting tool may include an operating part moving along the guide hole by pressure applied by a user.

The vacuum cleaner may further include rotary shafts combining the crevice tool with the slide member so as to be rotatable.

The rotary shafts may be provided on the lower end of the front portion of the slide member.

In accordance with another aspect of the present invention, a vacuum cleaner includes a main body generating suction force, a suction head contacting a surface to be cleaned and sucking air and dust from the surface, an extension pipe combined with the suction head, and a handle pipe, with which the extension pipe is separably combined, including a handle pipe body, a slide member combined with the handle pipe body so as to be slidable in the forward and backward direction, a dusting tool combined with the slide member so as to be slidable in the forward and backward direction and provided with a brush, and a crevice tool combined with the slide member so as to be rotatable between a folding position under the slide member and a connection position in front of the slide member.

At the connection position, an inner passage of the crevice tool may be connected to an inner passage of the slide member.

The vacuum cleaner may be operated in a first cleaning mode using the suction head, a second cleaning mode using the dusting tool, and a third cleaning mode using the crevice tool.

In the first cleaning mode, the slide member and the dusting tool may be moved backward, the crevice tool may be disposed at the folding position, and the extension pipe may be combined with the handle pipe body.

In the second cleaning mode, the extension pipe may be separated from the handle pipe body, the slide member and the dusting tool may be moved forward, and the crevice tool may be disposed at the folding position.

In the third cleaning mode, the extension pipe may be separated from the handle pipe body, the slide member may be moved forward, the dusting tool may be moved backward, and the crevice tool may be disposed at the connection position.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
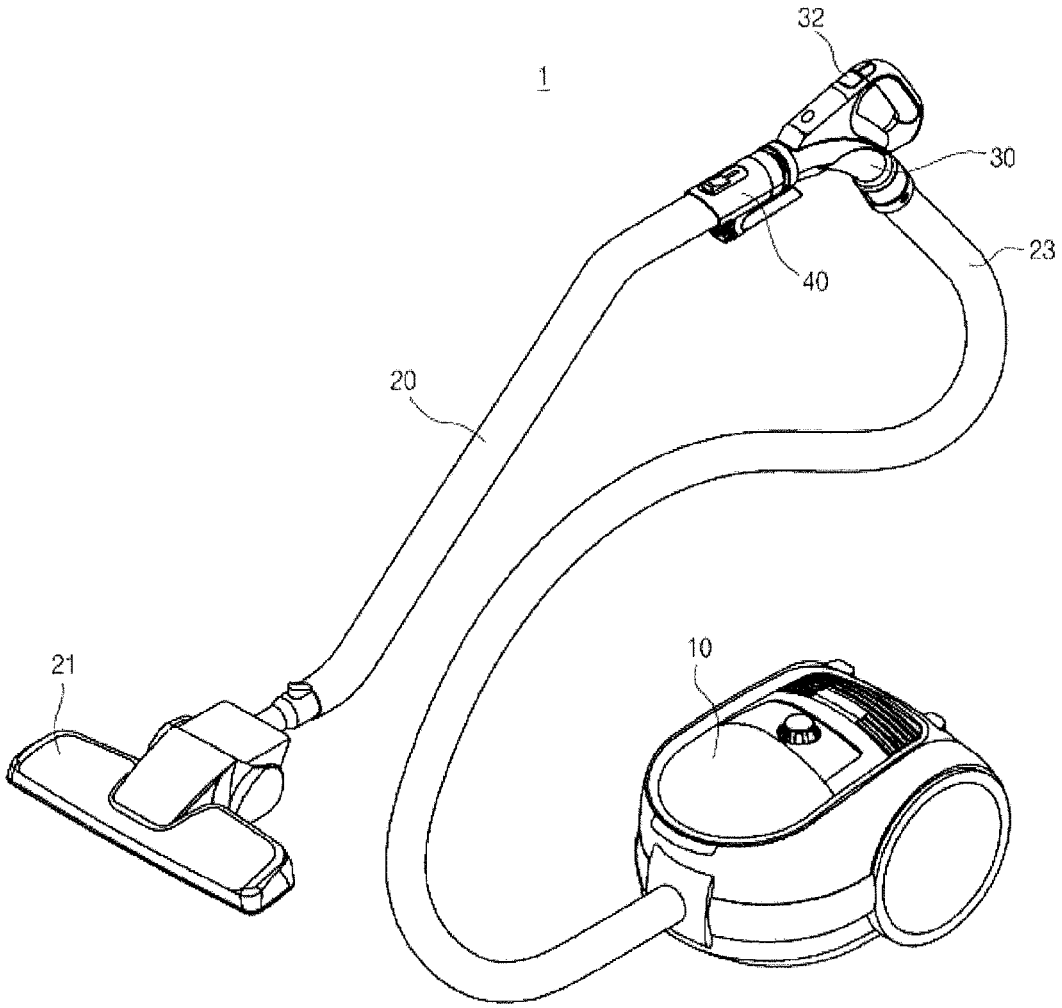
FIG. 1 is a perspective view illustrating a vacuum cleaner in accordance with one embodiment of the present invention.

Reference will now be made in detail to the embodiments of the present invention, examples of which are illustrated in the accompanying drawings, wherein like reference numerals refer to like elements throughout.

FIG. 1 is a perspective view illustrating a vacuum cleaner in accordance with one embodiment of the present invention.

With reference to FIG. 1, a vacuum cleaner 1 includes a main body 10 generating suction force, a suction head 21 contacting a surface to be cleaned and sucking air and dust from the surface, a handle pipe 30 for user operation, an extension pipe 20 connecting the suction head 21 and the handle pipe 30, and a flexible hose 23 connecting the handle pipe 30 and the main body 10.

A fan motor device (not shown) generating suction force and a dust collector (not shown) filtering out dust from sucked air are provided in the main body 10.

The suction head 21 sucks air and dust by suction force generated by the main body 10. The suction head 21 may be formed in a slightly flat type so as to contact a hard floor or a carpet.

The air and dust sucked through the suction head 21 may be guided to the extension pipe 20. The extension pipe 20 may be a pipe formed of resin or metal.

The handle pipe 30 may be detachably combined with the end of the extension pipe 20. A user may easily adjust the direction of the suction head 21 and the extension pipe 20 while gripping the handle pipe 30. Various operation buttons 32 to select the function of the vacuum cleaner 1 may be provided on the handle pipe 30.

The flexible hose 23 is provided between the handle pipe 30 and the main body 10. The flexible hose 23 may be formed of flexible resin so that the handle pipe 30 may freely move.

Through such configuration, air and dust are sucked into the suction head 21 from a surface to be cleaned by suction force generated from the main body 10, sequentially pass through the extension pipe 20, the handle pipe 30, and the flexible hose 23, and are guided to the main body 10. Dust is filtered out from the sucked air in the main body 10, and purified air may be discharged to the outside of the main body 10.

The vacuum cleaner 1 in accordance with the embodiment of the present invention further includes a sub-accessory assembly 40 provided integrally with the handle pipe 30 so as to be movable.

The sub-accessory assembly 40 serves to clean a surface, such as a narrow gap or a corner, as a substitute for the suction head 21 of a slightly flat type. Sub-accessories may include a dusting tool 60 (in FIG. 2) provided with a brush to clean a window frame or a corner, and a crevice tool 70 (in FIG. 2) formed in a flat and sharp type to clean a narrow gap.

In general, such sub-accessories may be provided separately from the handle pipe 30. Therefore, if a sub-accessory is used, combination of the sub-accessory with the handle pipe 30 may be troublesome.

Further, a separate space to store the sub-accessories is necessary and there is a danger of loss of the sub-accessories during storage.

In the vacuum cleaner 1 in accordance with the embodiment of the present invention, the sub-accessories may be assembled into the sub-accessory assembly 40 and provided integrally with the handle pipe 30. Therefore, a separate space to store the sub-accessories is not required and there is no danger of loss of the sub-accessories. Further, the sub-accessories may be used through simple sliding and rotating motions and thus, convenience in use of the sub-accessories is increased.

Hereinafter, the configuration and operation of the sub-accessory assembly 40 in accordance with the embodiment of the present invention will be described with reference to the accompanying drawings.

Figure 2:
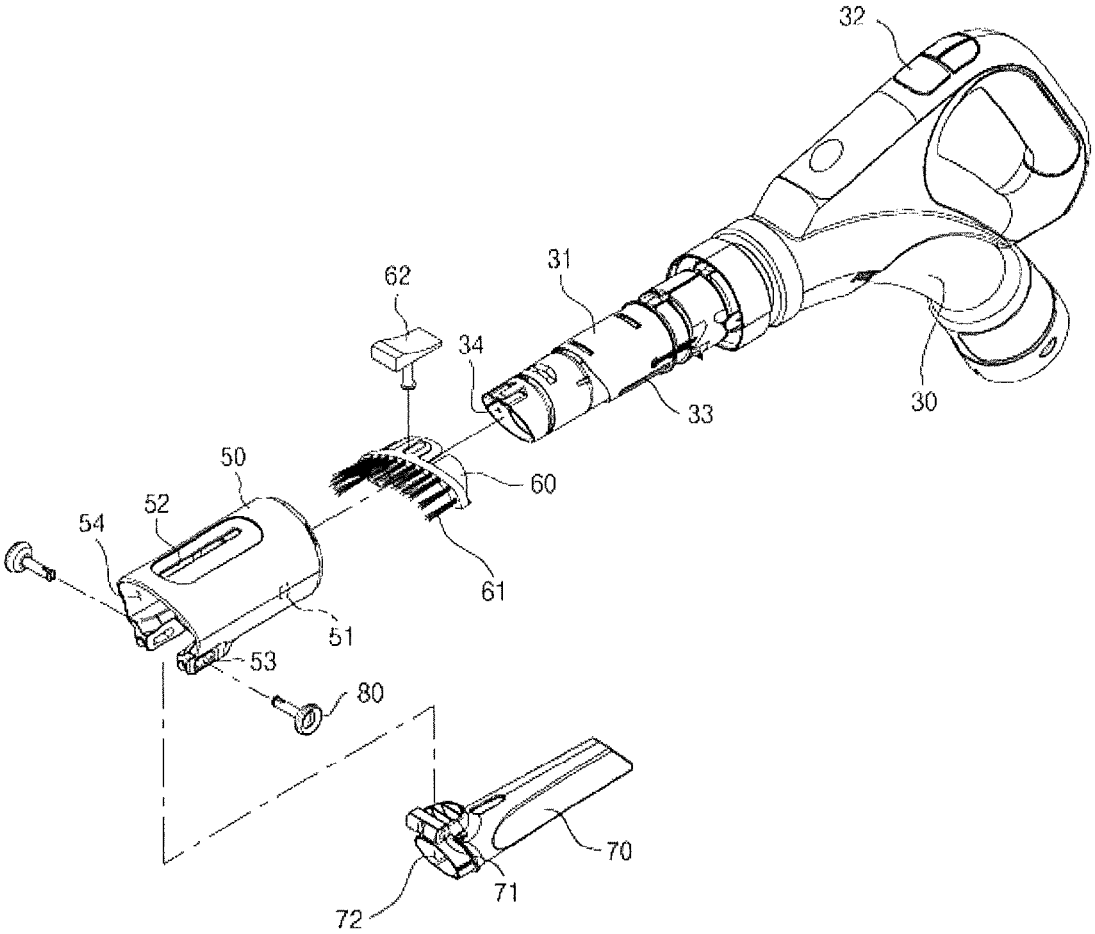
FIG. 2 is an exploded perspective view illustrating the configuration of a handle pipe of the vacuum cleaner of FIG. 1.

FIG. 2 is an exploded perspective view illustrating the configuration of the handle pipe of the vacuum cleaner of FIG. 1.

With reference to FIG. 2, the sub-accessory assembly 40 includes a slide member 50 combined with the handle pipe body 31 so as to be slidable in the forward and backward direction, the dusting tool 60 combined with the slide member 50 so as to be slidable in the forward and backward direction, and the crevice tool 70 combined with the slide member 50 so as to be rotatable.

The slide member 50 is combined with the outer circumferential surface of the handle pipe body 31 so as to surround the handle pipe body 31. An inner passage 54 of the slide member 50 communicates with an inner passage 34 of the handle pipe body 31.

Guide grooves 33 may be formed in the lengthwise direction on the outer surface of the handle pipe body 31 so as to guide movement of the slide member 50, and guide protrusions 51 inserted into the guide grooves 33 may be formed on the inner surface of the slide member 50.

At least one pair of guide protrusions 51 and at least one pair of guide grooves 33 may be formed. By inserting the guide protrusions 51 into the guide grooves 33, rotation of the slide member 50 with respect to the handle pipe body 31 or movement of the slide member 50 in other directions than the lengthwise direction are restricted, and the slide member 50 may move only in the lengthwise direction.

A brush 61 may be mounted on the dusting tool 60. The dusting tool 60 may be combined with the inner surface of the slide member 50 so as to be slidable.

For this purpose, a guide hole 52 to guide movement of the dusting tool 60 may be formed on the slide member 50 in the lengthwise direction. Further, an operating part 62 passing through the guide hole 52 may be formed on the dusting tool 60.

Through such configuration, a user may apply pressure to the operating part 62, and move the dusting tool 60 in the forward direction of the slide member 50 to protrude the dusting tool 60 or move the dusting tool 60 in the backward direction of the slide member 50 to retract the dusting tool 60 into the slide member 50.

The crevice tool 70 may be hinged to the lower end of the front portion of the slide member 50 so as to be rotatable. For this purpose, insertion holes 53 and 71 into which rotary shafts 80 are inserted may be formed on the slide member 50 and the crevice tool 70, and the rotary shafts 80 may be inserted into the insertion holes 53 and 71.

The crevice tool 70 may be rotated about the rotary shafts 80 between a folding position at which the crevice tool 70 is located under the slide member 50 and a connection position at which the crevice tool 70 is located in front of the slide member 50.

The crevice tool 70 is not connected to the slide member 50 when the crevice tool 70 is located at the folding position, and is connected to the slide member 50 when the crevice tool 70 is located at the connection position. That is, at the connection position of the crevice tool 70, the inner passage 54 of the slide member 50 may communicate with an inner passage 72 of the crevice tool 70.

Figure 3:
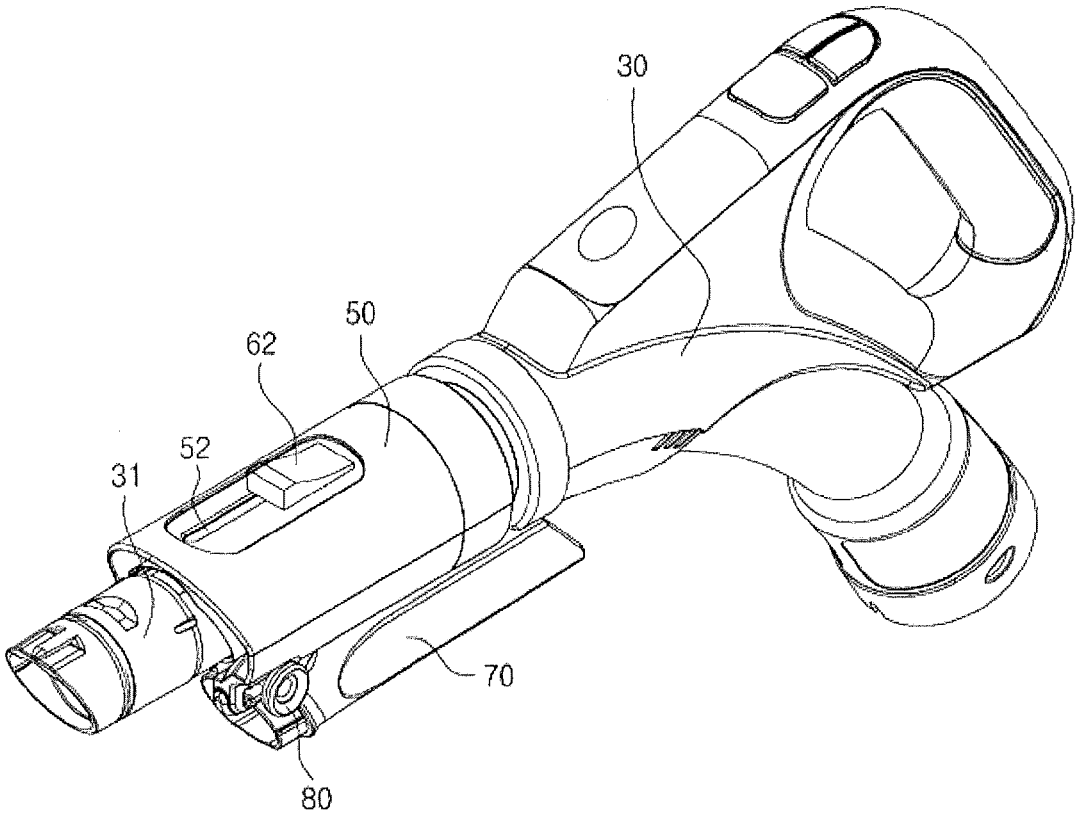
FIG. 3 is a perspective view illustrating a state of the handle pipe of the vacuum cleaner of FIG. 1 during normal cleaning.
Figure 4:
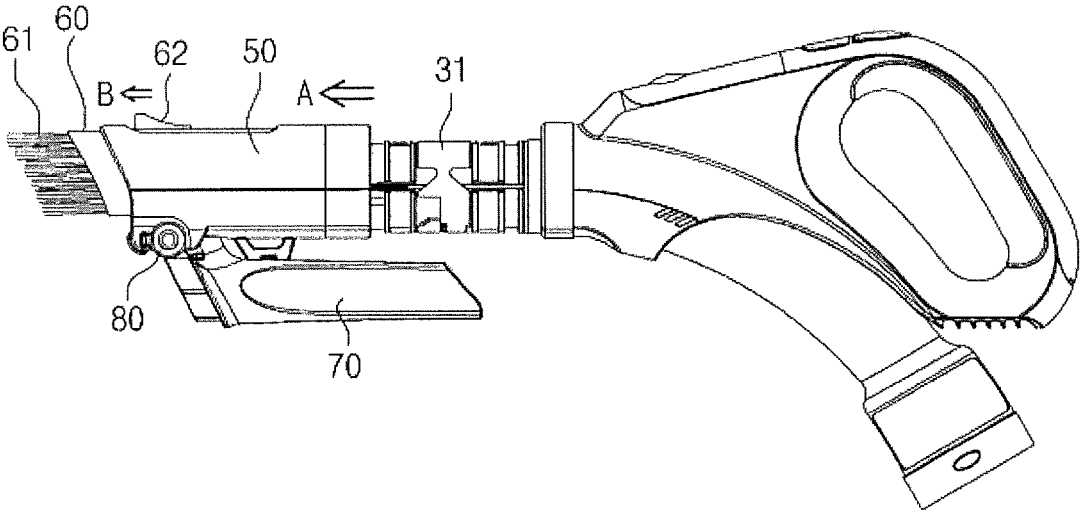
FIG. 4 is a perspective view illustrating a state of the handle pipe of the vacuum cleaner of FIG. 1 in which a dusting tool is used.
Figure 5:
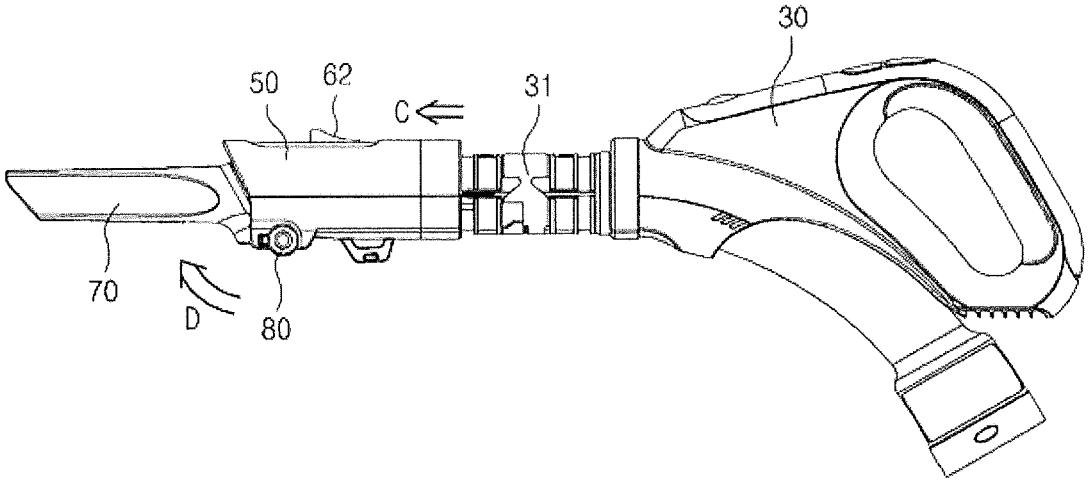
FIG. 5 is a perspective view illustrating a state of the handle pipe of the vacuum cleaner of FIG. 1 in which a crevice tool is used.

FIG. 3 is a perspective view illustrating a state of the handle pipe of the vacuum cleaner of FIG. 1 during normal cleaning, FIG. 4 is a perspective view illustrating a state of the handle pipe of the vacuum cleaner of FIG. 1 in which the dusting tool is used, and FIG. 5 is a perspective view illustrating a state of the handle pipe of the vacuum cleaner of FIG. 1 in which the crevice tool is used.

With reference to FIGS. 1 to 5, operation of the vacuum cleaner 1 in accordance with the embodiment of the present invention will be described.

The vacuum cleaner 1 may be operated in a first cleaning mode for normal cleaning using the suction head 21, a second cleaning mode for cleaning of a window frame or a corner using the dusting tool 60, and a third cleaning mode for cleaning of a gap using the crevice tool 70.

As exemplarily shown in FIG. 3, in the first cleaning mode, the slide member 50 and the dusting tool 60 are moved backward and the crevice tool 70 is disposed at the folding position. At this time, the handle pipe body 31 protrudes forward, the extension pipe 20 is combined with the handle pipe body 31, and thus, cleaning may be performed.

Thereafter, as exemplarily shown in FIG. 4, in the second cleaning mode, after the extension pipe 20 has been separated from the handle pipe body 31 in the first cleaning mode, the slide member 50 is moved forward (in the direction A) and the dusting tool 60 is moved forward (in the direction B). The dusting tool 60 may be moved by applying pressure to the operating part 62 protruding outward from the slide member 50.

In such a manner, the brush 61 of the dusting tool 60 may protrude forward just by sliding the slide member 50 and the dusting tool 60, and cleaning using the dusting tool 60 may be easily performed without separate separation and combination motions.

Thereafter, as exemplarily shown in FIG. 5, in the third cleaning mode, after the extension pipe 20 has been separated from the handle pipe body 31 in the first cleaning mode, the slide member 50 is moved forward (in the direction C) and the crevice tool 70 is rotated from the folding position to the connection position (in the direction D).

In such a manner, the crevice tool 70 may protrude forward just by sliding the slide member 50 and rotating the crevice tool 70, and cleaning using the crevice tool 70 may be easily performed without separate separation and combination motions.

As is apparent from the above description, in a vacuum cleaner in accordance with one embodiment of the present invention, a crevice tool cleaning a gap and a dusting tool cleaning a window frame and a corner are provided integrally with a handle pipe so as to be movable and thus, a separate space to store the crevice tool and the dusting tool is not required, there is no danger of loss of the crevice tool and the dusting tool, and the crevice tool and the dusting tool may be simply used through sliding and rotation motions and thus, convenience in use of the crevice tool and the dusting tool is increased.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A vacuum cleaner comprising:

a main body generating suction force;

a suction head contacting a surface to be cleaned and sucking air and dust from the surface;

a handle pipe for user operation;

a flexible hose connecting the handle pipe and the main body; and an extension pipe connecting the suction head and the handle pipe, wherein the handle pipe includes:

a handle pipe body between the extension pipe and the flexible hose with each other; and a sub-accessory assembly combined integrally with the handle pipe body so as to suck air and dust from the surface as a substitute for the suction head, the sub-accessory assembly further including:

a dusting tool that is extendable, and a crevice tool that is rotatably attached to the sub-accessory assembly to be rotatable between a connection position, in which the crevice tool is attached to a passageway connected to the handle pipe, and a folding position, in which the crevice tool is not connected to the passageway connected to the handle pipe.

2. The vacuum cleaner according to claim 1, wherein the dusting tool is provided with a brush and the crevice tool configured to clean a gap.

3. The vacuum cleaner according to claim 2, wherein the sub-accessory assembly further includes a slide member combined with the handle pipe body so as to be slidable, the dusting tool and the crevice tool being combined with the slide member.

4. The vacuum cleaner according to claim 3, wherein the dusting tool is combined with the slide member so as to be slidable.

5. The vacuum cleaner according to claim 3, wherein the slide member is provided to surround the outer circumferential surface of the handle pipe body.

6. The vacuum cleaner according to claim 3, wherein:

the handle pipe body includes guide grooves formed on the outer circumferential surface thereof to guide movement of the slide member; and the slide member includes guide protrusions formed on the inner circumferential surface thereof to move along the guide grooves.

7. The vacuum cleaner according to claim 3, wherein:

the slide member includes a guide hole formed on the outer circumferential surface to guide movement of the dusting tool; and the dusting tool includes an operating part moving along the guide hole by pressure applied by a user.

8. The vacuum cleaner according to claim 3, further comprising rotary shafts combining the crevice tool with the slide member so as to be rotatable.

9. The vacuum cleaner according to claim 8, wherein the rotary shafts are provided on the lower end of the front portion of the slide member.

10. The vacuum cleaner according to claim 3, wherein the crevice tool is rotatably attached to a slide member which slidably extends the dusting tool.

11. The vacuum cleaner according to claim 10, wherein the folding position of the crevice tool positions the crevice tool to be located under the slide member.

12. The vacuum cleaner according to claim 10, wherein the crevice tool is rotatably attached to the slide member using a insertion hole on the slide member, another insertion hole on the crevice tool, and a rotary shaft that extends through the insertion hole on the slide member and the others insertion hole on the crevice tool.

13. A vacuum cleaner comprising:

a main body generating suction force;

a suction head contacting a surface to be cleaned and sucking air and dust from the surface;

an extension pipe combined with the suction head; and a handle pipe, which is attachable to the extension pipe, including a handle pipe body, a slide member combined with the handle pipe body so as to be slidable in the forward and backward direction, a dusting tool combined with the slide member so as to be slidable in the forward and backward direction and provided with a brush, and a crevice tool combined with the slide member so as to be rotatable between a folding position under the slide member, in which the crevice tool is not connected to a passageway connected to the handle pipe, and a connection position, in which the crevice tool is attached to the passageway connected to the handle pipe and in which the crevice tool is located in front of the slide member.

14. The vacuum cleaner according to claim 13, wherein, at the connection position, an inner passage of the crevice tool is connected to an inner passage of the slide member which is attached to the passageway connected to the handle pipe while the crevice tool is rotatably attached.

15. The vacuum cleaner according to claim 13, wherein the vacuum cleaner is operated in a first cleaning mode using the suction head, a second cleaning mode using the dusting tool, and a third cleaning mode using the crevice tool.

16. The vacuum cleaner according to claim 13, wherein, in a first cleaning mode using the suction head, the slide member and the dusting tool are moved backward, the crevice tool is disposed at the folding position, and the extension pipe is combined with the handle pipe body.

17. The vacuum cleaner according to claim 13, wherein, in a second cleaning mode using the dusting tool, the extension pipe is separated from the handle pipe body, the slide member and the dusting tool are moved forward, and the crevice tool is disposed at the folding position.

18. The vacuum cleaner according to claim 13, wherein, in a third cleaning mode using the crevice tool, the extension pipe is separated from the handle pipe body, the slide member is moved forward, the dusting tool is moved backward, and the crevice tool is disposed at the connection position.

* * * * *